US011795779B2

(12) United States Patent
Kumar

(10) Patent No.: US 11,795,779 B2
(45) **Date of Patent: *Oct. 24, 2023**

(54) DOWNHOLE INFLOW PRODUCTION RESTRICTION DEVICE

(71) Applicant: Welltec Oilfield Solutions AG, Zug (CH)

(72) Inventor: Satish Kumar, Zug (CH)

(73) Assignee: Welltec Oilfield Solutions AG, Zug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 17/578,540

(22) Filed: Jan. 19, 2022

(65) Prior Publication Data

US 2022/0136367 A1 May 5, 2022

Related U.S. Application Data

(63) Continuation of application No. 16/207,533, filed on Dec. 3, 2018, now Pat. No. 11,346,180.

(30) Foreign Application Priority Data

Dec. 4, 2017 (EP) ..... 17205082

(51) Int. Cl.
*E21B 34/06* (2006.01)
*E21B 43/12* (2006.01)
(Continued)

(52) U.S. Cl.
CPC ..... *E21B 34/063* (2013.01); *E21B 43/12* (2013.01); *E21B 33/127* (2013.01); *E21B 43/08* (2013.01); *E21B 2200/08* (2020.05)

(58) Field of Classification Search
CPC ..... E21B 34/063; E21B 34/06; E21B 43/12; E21B 43/08
See application file for complete search history.

(56) References Cited

U.S. PATENT DOCUMENTS 3,599,713 A * 8/1971 Jenkins ..... E21B 34/063 166/368
7,325,616 B2 2/2008 Lopez de Cardenas et al.
(Continued)

FOREIGN PATENT DOCUMENTS

CN 205477530 U 8/2016
RU 2 316 643 C2 2/2008
(Continued)

OTHER PUBLICATIONS

Extended Search Report for EP17205082.5, dated May 30, 2018, 6 pages.
(Continued)

*Primary Examiner* — Giovanna Wright
(74) *Attorney, Agent, or Firm* — Nixon & Vanderhye P.C.

(57) ABSTRACT

The present invention relates to a downhole inflow production restriction device for mounting in an opening in a well tubular metal structure arranged in a wellbore, the downhole inflow production restriction device comprising a device opening, and a brine dissolvable element configured to prevent flow from within the well tubular metal structure through the device opening to an outside of the well tubular metal structure before being at least partly dissolved in brine, wherein the brine dissolvable element is at least partly made of a magnesium alloy. The present invention also relates to a downhole completion system and to a completion method.

19 Claims, 6 Drawing Sheets

(51) Int. Cl.
*E21B 33/127* (2006.01)
*E21B 43/08* (2006.01)

(56) References Cited

U.S. PATENT DOCUMENTS

| | | | | |
|---|---|---|---|---|
| 11,346,180 | B2 * | 5/2022 | Kumar | E21B 43/12 |
| 2012/0067588 | A1 | 3/2012 | Awid | |
| 2012/0125626 | A1 | 5/2012 | Constantine | |
| 2014/0020898 | A1 * | 1/2014 | Holderman | E21B 43/12 166/229 |
| 2015/0068757 | A1 * | 3/2015 | Hofman | E21B 34/063 166/318 |
| 2015/0101823 | A1 | 4/2015 | Carrejo | |
| 2016/0317957 | A1 * | 11/2016 | Carrejo | B01D 29/01 |
| 2016/0326837 | A1 | 11/2016 | Bowen | |
| 2016/0333655 | A1 | 11/2016 | Fripp | |
| 2017/0234103 | A1 | 8/2017 | Frazier | |
| 2019/0169959 | A1 | 6/2019 | Kumar | |
| 2020/0011160 | A1 * | 1/2020 | Cox | E21B 34/08 |
| 2020/0095845 | A1 * | 3/2020 | Watkins | E21B 34/063 |

FOREIGN PATENT DOCUMENTS

| | | |
|---|---|---|
| WO | WO 2016/032761 | 3/2016 |
| WO | WO 2017/160988 | 9/2017 |
| WO | WO 2017/187117 | 11/2017 |

OTHER PUBLICATIONS

Notification of the Results of Patentability Examination of an Invention dated Dec. 23, 2020 in Russian Application No. 2020120494/03(034940), with English translation, 12 pages.

Kumar, U.S. Appl. No. 16/207,533, filed Dec. 3, 2018, for "Downhole Inflow Production Restriction Device," (parent application).

* cited by examiner

DOWNHOLE INFLOW PRODUCTION RESTRICTION DEVICE

CROSS REFERENCE TO RELATED APPLICATIONS

This application is a continuation of U.S. application Ser. No. 16/207,533, filed Dec. 3, 2018, which claims priority to EP Patent Application No. 17205082.5 filed Dec. 4, 2017, the entire contents of each of which are hereby incorporated by reference in their entirety.

BACKGROUND

The present invention relates to a downhole inflow production restriction device for mounting in an opening in a well tubular metal structure arranged in a wellbore. The present invention also relates to a downhole completion system and to a completion method.

BRIEF SUMMARY

When completing a well, there is presently a need for a wash pipe for well clean-up, alternatively the known inflow control valves need to be operated subsequently by intervention via a tool or pipe. Such use of either a wash pipe and/or an intervention tool delays the completion process since time is spent assembling and running in the wash pipe and the tool.

In order to prevent intervention so as to make the well ready for production, attempts have been made to plug the openings in the casing with an acid-dissolvable plug. However, the acid is very corrosive to the casing and the components, and only a few very expensive completion components can withstand such acid treatment. Furthermore, some formations cannot withstand such acid either, and acid-dissolvable plugs can therefore not be used in such formations.

Furthermore, the mud circulated during run-in-hole (RIH) operations tends to get stuck in the annular space underneath the screen and the base pipe, around which pipe the space extends. The mud stuck under the screens is very difficult to remove subsequently, and the mud thus tends to fill out part of the screen, resulting in a significant decrease in screen efficiency.

It is an object of the present invention to wholly or partly overcome the above disadvantages and drawbacks of the prior art. More specifically, it is an object to provide an improved downhole completion system which is easier to deploy without the need of subsequent intervention and without damaging the formation and/or the completion components significantly.

It is another object of the present invention to provide a downhole completion system which makes it possible to remove mud from the screen and thus increase the efficiency of the screen during production.

The above objects, together with numerous other objects, advantages and features, which will become evident from the below description, are accomplished by a solution in accordance with the present invention by a downhole inflow production restriction device for mounting in an opening in a well tubular metal structure arranged in a wellbore, the downhole inflow production restriction device comprising:

a device opening, and a brine dissolvable element configured to prevent flow from within the well tubular metal structure through the device opening to an outside of the well tubular metal structure before being at least partly dissolved in brine, wherein the brine dissolvable element is at least partly made of a magnesium alloy.

The brine dissolvable element may be part of a valve having a first position and a second position, and the valve may comprise a valve housing and a movable part.

Moreover, the brine dissolvable element may be the movable part of the valve, the brine dissolvable element being movable between the first position and the second position.

Also, the first position the valve may allow fluid to flow into the well tubular metal structure, and in the second position the valve may prevent fluid from flowing out of the well tubular metal structure.

Furthermore, the brine dissolvable element may comprise both at least part of the valve housing and the movable part.

In addition, the movable part may be at least partly arranged in the device opening.

The valve housing may comprise a first housing part and a second housing part, the first housing part being fixedly arranged in the opening of the well tubular metal structure and the second housing part being part of the brine dissolvable element.

Moreover, the main part of the brine dissolvable element and/or the main part of the valve may be extending into the well tubular metal structure from the opening in the well tubular metal structure.

Further, the brine dissolvable element may comprise a rod part, a first projecting flange arranged at a first end of the rod part and a second projecting flange arranged at a second end of the rod part, the rod part extending through the device opening, so that the first projecting flange is arranged outside the device opening at one side of the restriction device and has an outer diameter which is larger than an inner diameter of the device opening, and so that the second projecting flange is arranged outside the device opening at the other side of the restriction device and has an outer diameter which is larger than the inner diameter of the device opening.

Also, the second projecting flange may be facing the inside of the well tubular metal structure, the first projecting flange may have a flange opening allowing fluid to flow from outside of the well tubular metal structure to inside of the well tubular metal structure when the valve is in the first position.

Additionally, the rod part may have a part having a decreased outer diameter.

Furthermore, brine dissolvable element may be a plug.

Said brine dissolvable element may be fixedly arranged in the device opening.

Moreover, the brine dissolvable element may comprise a spring element, such as a spiral spring or a Belleville spring/washer.

The downhole inflow production restriction device according to the present invention may further comprise an insert defining the device opening.

Further, the insert may be made of ceramic material.

In addition, the brine dissolvable element may comprise an indentation forming a weak point, so that a pressure increase in the well tubular metal structure can cause the brine dissolvable element to break at this weak point.

The downhole inflow production restriction device according to the present invention may further comprise a snap ring for fastening the downhole inflow production restriction device in the opening of the well tubular metal structure.

The present invention also relates to a downhole completion system comprising the well tubular metal structure and the downhole inflow production restriction device according to the present invention.

Said well tubular metal structure may comprise at least one screen mounted on the outer face of the well tubular metal structure and opposite the downhole inflow production restriction device.

Moreover, the well tubular metal structure may comprise at least one annular barrier for providing zonal isolation.

Furthermore, the annular barrier may have an expandable metal sleeve surrounding the well tubular metal structure forming an annular space there between, the well tubular metal structure having an expansion opening through which fluid enters to expand the expandable metal sleeve.

The annular barrier may also have a valve system which may have a first position in which fluid from the well tubular metal structure is allowed to flow into the annular space and a second position in which fluid communication between the wellbore and the annular space is provided in order to pressure equalise the pressure there between.

Also, the annular barrier may be a swellable packer, a mechanical packer or an elastomeric packer.

In another embodiment, the downhole completion system may further comprise a sliding sleeve having a sleeve edge for breaking part of the valve.

The present invention also relates to a completion method for preparing a well for an optimal production, said completion method comprising:

running a well tubular metal structure in the borehole while circulating mud, the well tubular metal structure having an opening in which a downhole inflow production restriction device mentioned above is mounted, circulating brine from inside the well tubular metal structure out through a bottom of the well tubular metal structure and up along the well tubular metal structure, decreasing the pressure in the well tubular metal structure, and initiating production of fluid flowing into the well tubular metal structure through the device opening by dissolving the brine dissolvable element in the device opening so that mud is transported with the fluid uphole.

The completion method according to the present invention may further comprise:

dropping a ball to be seated near the bottom of the well tubular metal structure to pressurise the well tubular metal structure from within, and expanding an expandable metal sleeve of an annular barrier by allowing fluid of the increased pressure in the well tubular metal structure to enter an annular space between the expandable metal sleeve and the well tubular metal structure through an expansion opening in the well tubular metal structure.

Said completion method may further comprise breaking the weak points by the increased pressure in the well tubular metal structure.

BRIEF DESCRIPTION OF THE DRAWINGS

The invention and its many advantages will be described in more detail below with reference to the accompanying schematic drawings, which for the purpose of illustration, show some non-limiting embodiments and in which.

DETAILED DESCRIPTION

All the figures are highly schematic and not necessarily to scale, and they show only those parts which are necessary in order to elucidate the invention, other parts being omitted or merely suggested.

Figure 1:
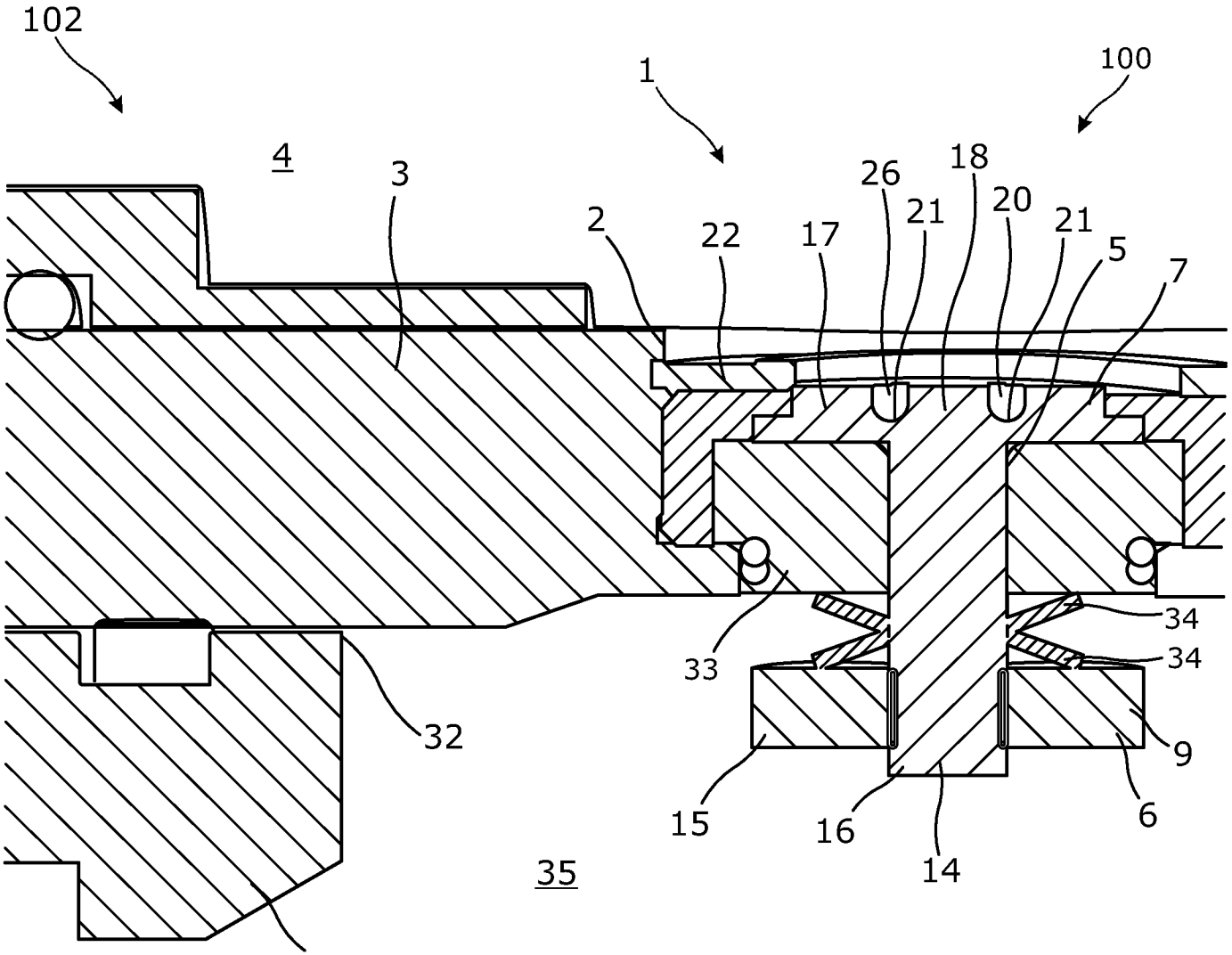
FIG. 1 shows a cross-sectional view of part of downhole completion system having a downhole inflow production restriction device in its second position.

FIG. 1 shows part of a downhole completion system 100 comprising a downhole inflow production restriction device 1 for mounting in an opening 2 in a well tubular metal structure 3 arranged in a wellbore 4. The downhole inflow production restriction device 1 comprises a device opening 5 and a brine dissolvable element 6 configured to prevent flow from an inside 35 of the well tubular metal structure 3 through the device opening 5 to an outside, i.e. the wellbore 4, of the well tubular metal structure before the brine dissolvable element 6 is at least partly dissolved in brine. The brine dissolvable element is at least partly made of a magnesium alloy which is dissolvable in brine, so that the dissolving process is initiated during clean-up, i.e. the mud is flushed out of the well by circulating brine down through the well tubular metal structure 3 and out through the bottom and up along the well tubular metal structure.

By having a brine dissolvable element 6 configured to prevent flow from an inside 35 of the well tubular metal structure through the device opening 5 to an outside, the well tubular metal structure can easily be cleaned out, and the device opening is at the same time opened as the brine dissolvable element 6 is dissolved, eliminating the need of subsequently intervening the well. The downhole completion system 100 can thus be run in with the downhole inflow production restriction device 1 in an "open" position, since the downhole inflow production restriction device is not subsequently opened by e.g. shifting position of the downhole inflow production restriction device. The mud is often displaced with brine, and by using a brine dissolvable element 6 for blocking the device opening 5, opening of the device and clean out are performed in one operation. Furthermore, since brine is not as corrosive as acid, which is used in prior art solutions to dissolve a plug, the well tubular metal structure and other completion components are not damaged as much as when using acid.

The brine dissolvable element 6 is part of a valve 7 comprising a valve housing 8 and a movable part 9. The valve has a first position and a second position, wherein in the first position the valve allows fluid to flow into the well tubular metal structure, and in the second position the valve prevents fluid from flowing out of the well tubular metal structure.

By having the brine dissolvable element 6 being part of a valve, the brine dissolvable element is at least partly dissolved during the clean-up with brine. However, before the brine has dissolved the brine dissolvable element enough to separate it from the remaining part of the valve, the valve allows fluid from the wellbore into the well tubular metal structure instantly after the pressure has been relieved, and thus the mud inside a screen is flushed out before it settles and hardens in the screen. By having a valve instead of a plug, the production of fluid is initiated instantly after pressure-relief, and then the clean-out is more efficient, making the screen more efficient as the mud no longer occupies as much of the flow area underneath the screen.

In FIG. 1, the brine dissolvable element 6 is the movable part 9 of the valve so that the brine dissolvable element is movable between the first position and the second position. The movable part is partly arranged in the device opening 5 and partly arranged outside the device opening 5. The brine dissolvable element 6 comprises a rod part 14, a first projecting flange 15 and a second projecting flange 17. The first projecting flange 15 is arranged at a first end 16 of the rod part and the second projecting flange 17 is arranged at a second end 18 of the rod part. The rod part 14 extends through the device opening 5, so that the first projecting flange 15 is arranged outside the device opening at one side of the downhole inflow production restriction device and the second projecting flange 17 is arranged in the device opening at the other side of the restriction device 1. The first projecting flange has an outer diameter $OD_1$ (shown in FIG. 3) which is larger than an inner diameter $ID_D$ (shown in FIG. 3) of the device opening 5, and the second projecting flange 17 has an outer diameter $OD_2$ (shown in FIG. 3) which is larger than the inner diameter of the device opening.

The valve 7 of FIG. 1 further comprises a spring element 34, i.e. a Belleville spring/washer, in order to force the movable part 9 to close the device opening and thus maintain the movable part in the second position. Furthermore, the second projecting flange 17 comprises an indentation 20 creating a weak point 21 and the second projecting flange is fixedly connected to the well tubular metal structure. When the inside of the well tubular metal structure is pressurised, the pressure acts on the first projecting flange 15 and the movable part 9 is moved radially outwards, compressing the spring element and breaking the second projecting flange 17, so that when the pressure is released, the rod part is released from the second projecting flange 17 and moves radially inwards and out of the device opening if not dissolved.

The indentation 20 creating a weak point 21 may thus be a backup solution if the brine dissolvable element 6 is not dissolved or at least not dissolved to a sufficient extent for it to be released to open the device opening 5.

Figure 2:
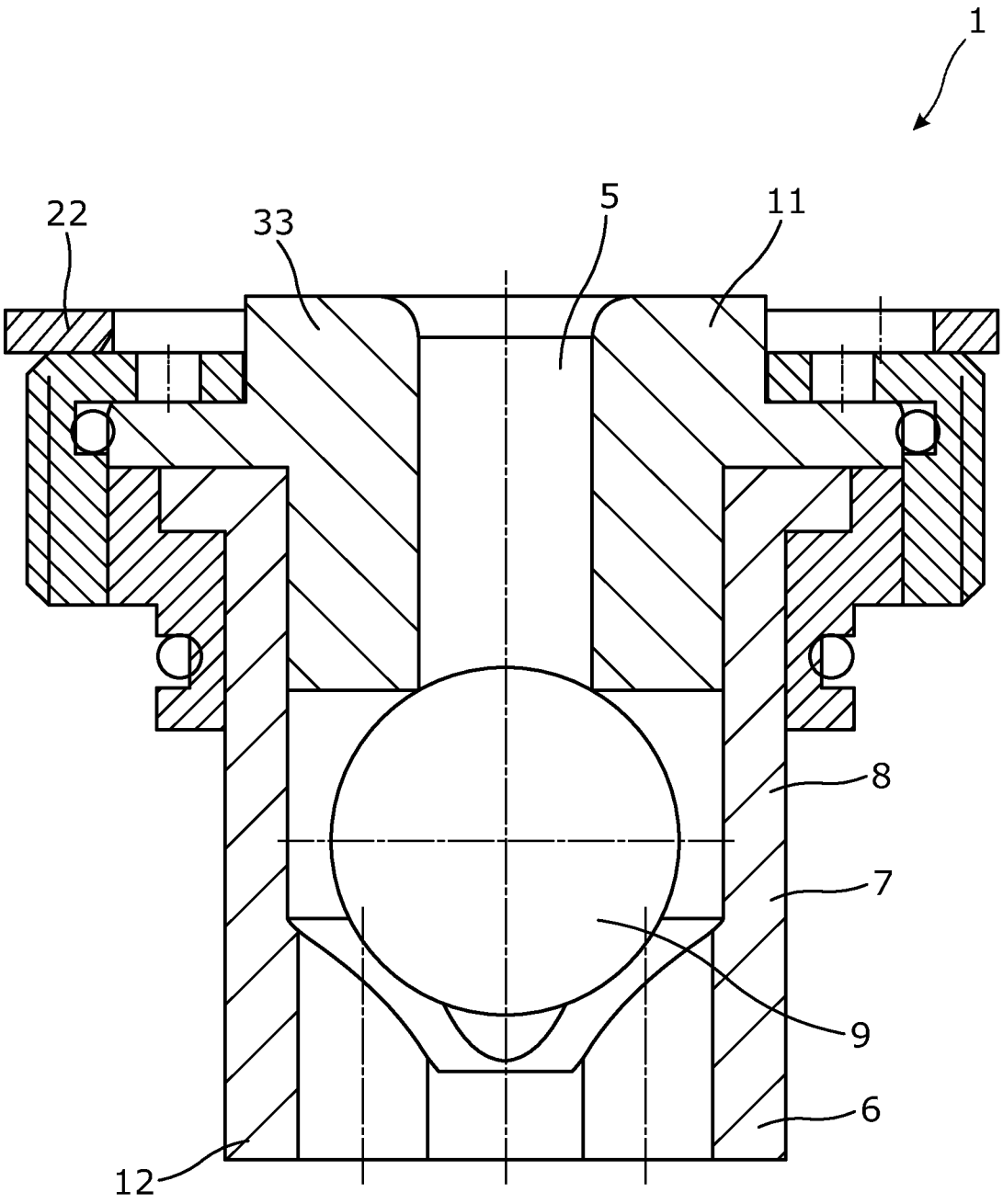
FIG. 2 shows a cross-sectional view of another downhole inflow production restriction device in its second position.

In FIG. 2, the valve housing 8 comprises a first housing part 11 and a second housing part 12. The first housing part is fixedly arranged in the opening of the well tubular metal structure and the second housing part is part of the brine dissolvable element. Thus, the brine dissolvable element 6 comprises both the second part 12 of the valve housing 8 and the movable part 9. In another embodiment, the brine dissolvable element is the second housing part 12, so that when the second housing part is dissolved, and the ball is released to flow with the fluid in the well tubular metal structure 3.

When having a brine dissolvable element 6, the valve 7 may extend significantly into the inside of the well tubular metal structure, since when dissolving the brine dissolvable element 6, the well tubular metal structure gains its full inner bore without any part of the valve extending into the inside of the well tubular metal structure. In FIG. 2, the main part of the brine dissolvable element 6 extends into the well tubular metal structure from the opening in the well tubular metal structure, but after the brine dissolvable element has been at least partly dissolved, that main part is no longer extending into the well tubular metal structure, since the part is dissolved or released from the remaining part of the downhole inflow production restriction device 1.

Figure 3:
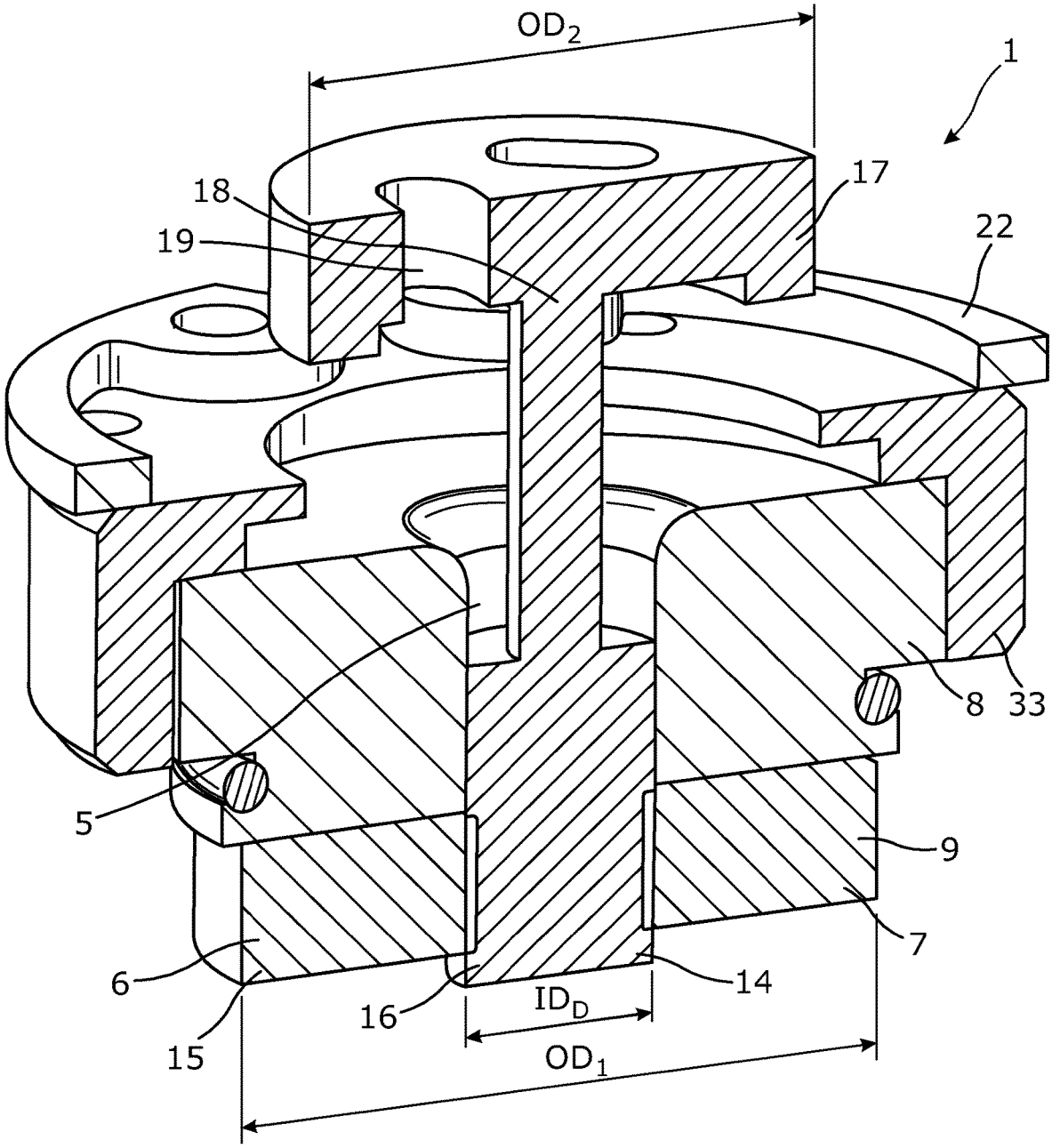
FIG. 3 shows a cross-sectional view of yet another downhole inflow production restriction device in its second position.
Figure 4:
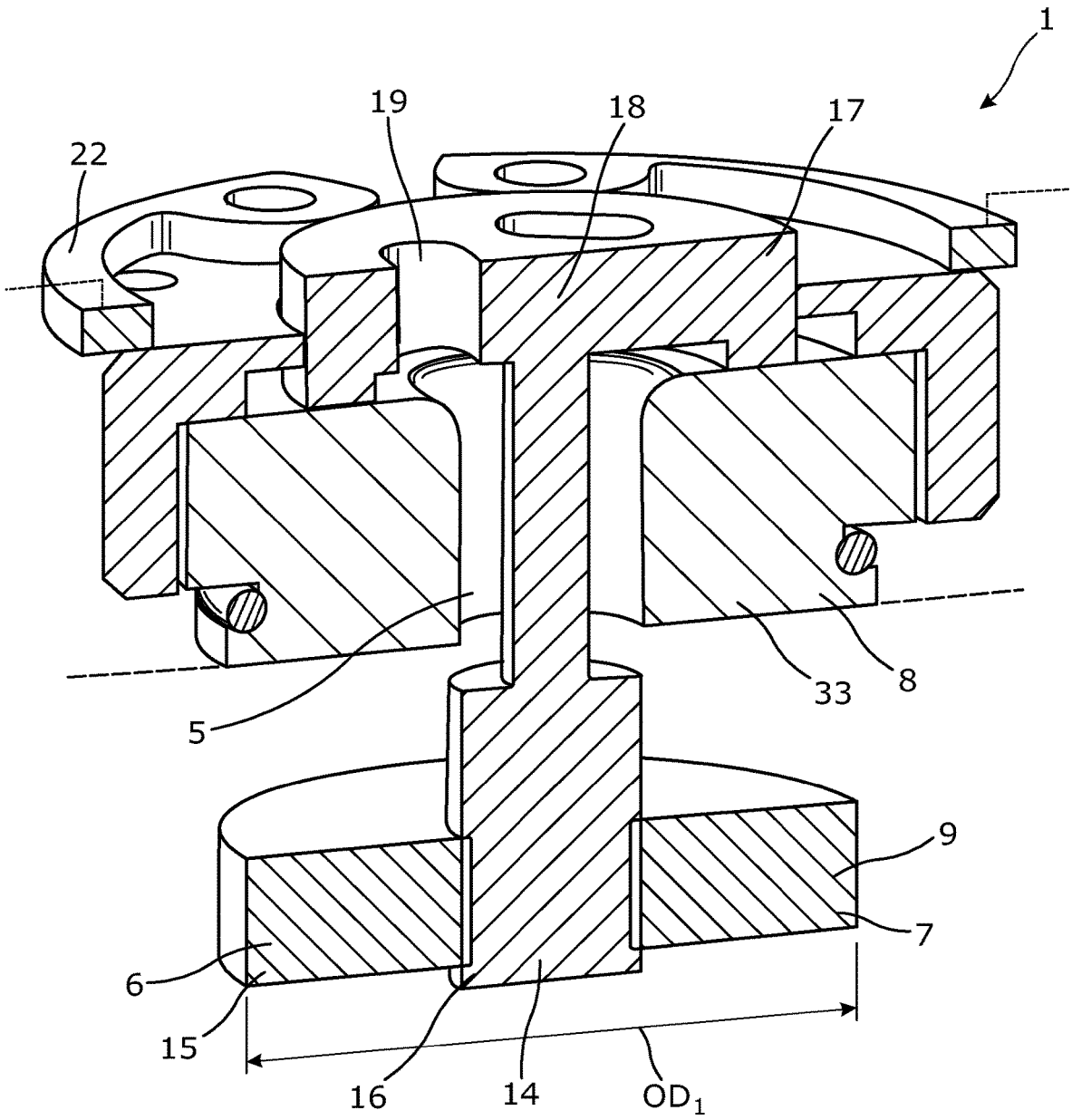
FIG. 4 shows the downhole inflow production restriction device of FIG. 3 in its first position.

In FIG. 3, the valve 7 has a rod part 14 and a first projecting flange 15 and a second projecting flange 17. The first projecting flange 15 is facing the inside of the well tubular metal structure 3 and the second projecting flange 17 has a flange opening 19 allowing fluid to flow from outside of the well tubular metal structure to inside of the well tubular metal structure when the valve 7 is in the first position. In FIG. 3, the valve 7 is in its closed and second position. In FIG. 4, the valve is in its first and open position in which the fluid is allowed to flow from the outside of the well tubular metal structure through the flange opening 19 along a part of the rod part 14 having a decreased outer diameter and into the inside of the well tubular metal structure.

In another embodiment, the brine dissolvable element 6 may be a plug arranged in the device opening. The brine dissolvable element may thus be fixedly arranged in the device opening. The plug may have an indentation 20, as shown in FIG. 1, creating the weak point 21, and thus the plug does not have to be fully dissolved before being released, since the brine may dissolve the plug to an extent which is sufficient for the flange having the weak point to break. Thus, the combination of a brine dissolvable plug and at least one indentation can provide a reliable closure of the device opening which can also be opened by subsequently intervening the well with a tool.

In another embodiment, the brine dissolvable element may comprise a spring element, such as a spiral spring, a Belleville spring/washer or similar spring element.

As can be seen in FIGS. 1-4, the downhole inflow production restriction device 1 further comprises an insert 33 defining the device opening 5. The insert can be in form-stable material, such a ceramic material, which is not easily worn. The insert can therefore be made with a very precise size opening which is capable of withstanding wear from the fluid entering the well tubular metal structure over many years.

The downhole inflow production restriction device 1 further comprises some kind of fastening means, such as a snap ring 22, for fastening the downhole inflow production restriction device in the opening of the well tubular metal structure 3.

Figure 5:
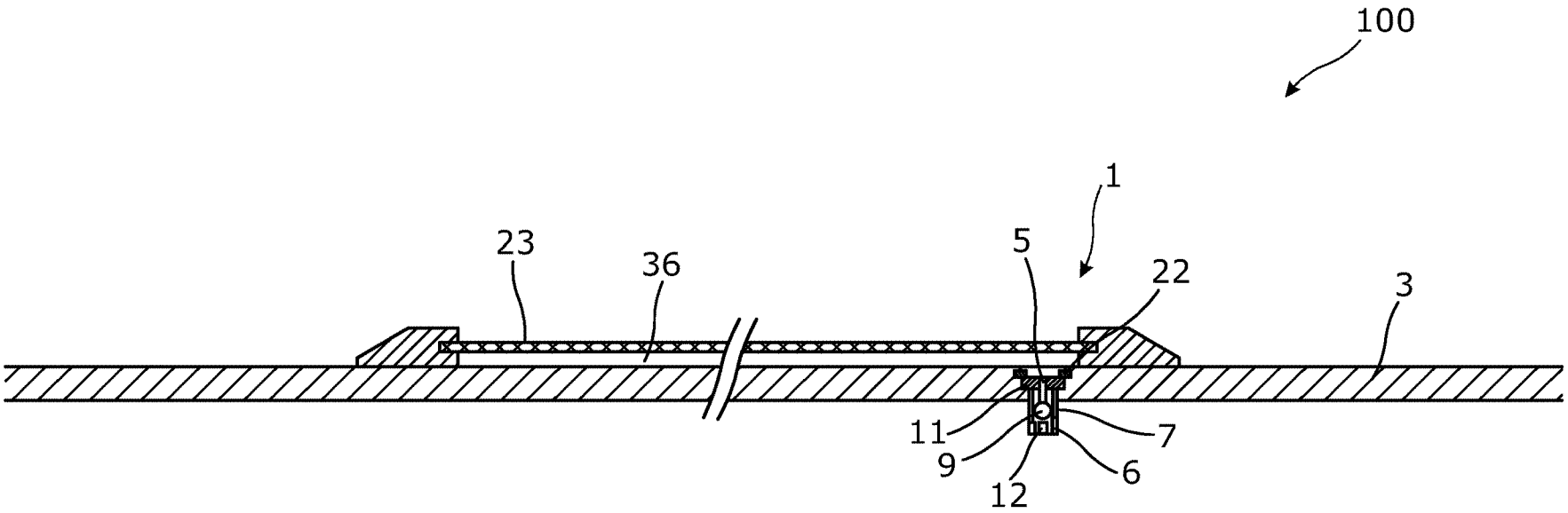
FIG. 5 shows a cross-sectional view of part of a downhole completion system having a downhole inflow production restriction device and a screen.

In FIG. 5, the downhole completion system 100 comprises the well tubular metal structure 3 and the downhole inflow production restriction device 1 inserted in an opening therein. The well tubular metal structure further comprises one screen 23 mounted on the outer face of the well tubular metal structure providing an annular space 36 and the screen is mounted opposite the downhole inflow production restriction device 1.

Figure 6:
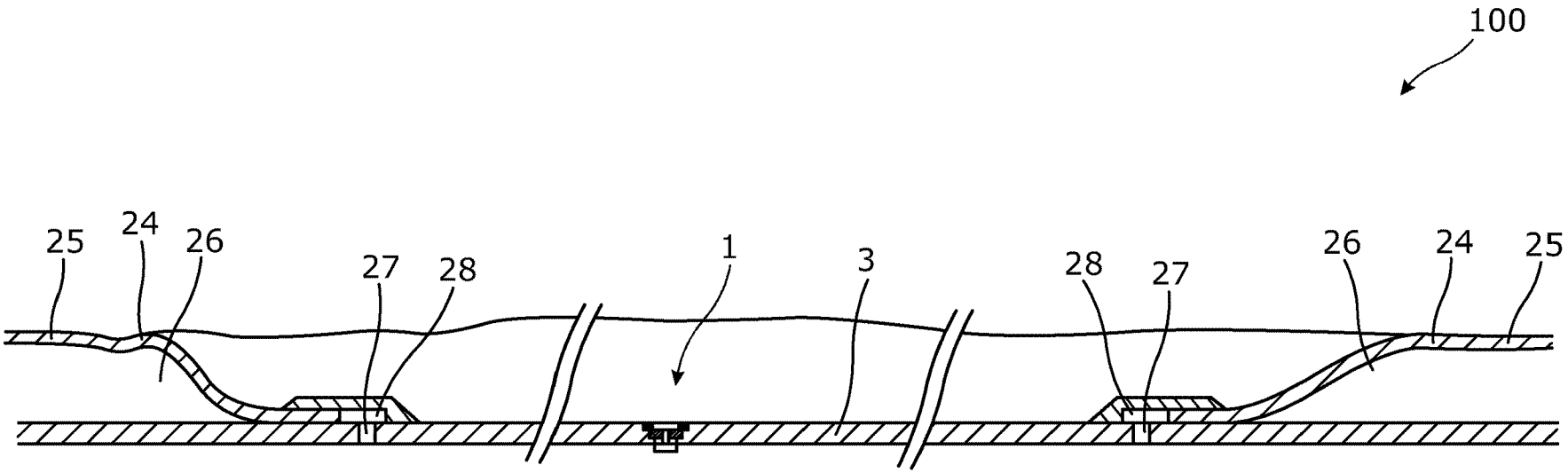
FIG. 6 shows cross-sectional view of part of a downhole completion system having a downhole inflow production restriction device arranged in between two annular barriers.

In FIG. 6, the well tubular metal structure 3 of the downhole completion system 100 comprises two annular barriers 24 for providing zonal isolation. The downhole inflow production restriction device 1 is arranged between the annular barriers, so that fluid for expanding the annular barriers cannot flow out of the well tubular metal structure through the downhole inflow production restriction device 1 before the brine dissolvable element is dissolved. In this way, the annular barriers can be expanded, while intervention of the well to open the downhole inflow production restriction device 1 is still not required. Each of the annular barriers has an expandable metal sleeve 25 surrounding the well tubular metal structure 3, forming an annular space 26 there between. The well tubular metal structure has an expansion opening 27 through which fluid enters to expand the expandable metal sleeve. The annular barrier may furthermore have a valve system 28 which has a first position, in which fluid from the well tubular metal structure is allowed to flow into the annular space and a second position, in which fluid communication between the wellbore and the annular space is provided in order to pressure equalise the pressure there between—i.e. across the expandable metal sleeve 25.

Instead of the annular barrier being such metal packer, the annular barrier may be a swellable packer, a mechanical packer or an elastomeric packer.

The downhole completion system 100 may further comprise a sliding sleeve 31 having a sleeve edge 32 for breaking part of the valve 7, as shown in FIG. 1. The sliding sleeve can thus be used to cut off the first projecting flange by pulling the sleeve by e.g. a tool and may thus serve as a backup solution if the brine dissolvable element for some reason does not dissolve significantly to free the device opening.

The well is thus prepared for an optimal production by running the well tubular metal structure in the borehole while circulating mud, circulating brine from inside the well tubular metal structure out though a bottom of the well tubular metal structure and up along the well tubular metal structure, and then decreasing the pressure in the well tubular metal structure for initiating production of fluid flowing into the well tubular metal structure through e.g. a screen and then into the device opening, so that mud is transported with the fluid uphole and the screen is cleaned for mud.

The well can also be prepared for an optimal production by running the well tubular metal structure in the borehole while circulating mud, circulating brine from inside the well tubular metal structure out through a bottom of the well tubular metal structure and up along the well tubular metal structure, and then dropping a ball to be seated near the bottom of the well tubular metal structure to pressurise the well tubular metal structure from within. When the pressure has been increased significantly, the expandable metal sleeve of an annular barrier is expanded by allowing fluid of the increased pressure in the well tubular metal structure to enter an annular space between the expandable metal sleeve and the well tubular metal structure through an expansion opening in the well tubular metal structure. Subsequently, the pressure is released and the production initiated.

The tool for pulling a sliding sleeve may be a stroking tool which is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. Downhole inflow production restriction device for mounting in an opening in a well tubular metal structure arranged in a wellbore, the downhole inflow production restriction device comprising:

a device opening, and a brine dissolvable element configured to prevent flow from within the well tubular metal structure through the device opening to an outside of the well tubular metal structure before the brine dissolvable element is at least partly dissolved in brine, wherein the brine dissolvable element is at least partly made of a magnesium alloy and comprises an indentation forming a weak point where an increase in pressure in the well tubular metal structure is configured to cause the brine dissolvable element to break at the weak point, and wherein a part of the brine dissolvable element is configured to extend into the well tubular metal structure from the opening in the well tubular metal structure.

2. Downhole inflow production restriction device according to claim 1, wherein the brine dissolvable element is part of a valve having a first position and a second position, and the valve comprises a valve housing and a movable part.

3. Downhole inflow production restriction device according to claim 2, wherein the brine dissolvable element is the movable part of the valve, the brine dissolvable element being movable between the first position and the second position.

4. Downhole inflow production restriction device according to claim 2, wherein in the first position the valve allows fluid to flow into the well tubular metal structure, and in the second position the valve prevents fluid from flowing out of the well tubular metal structure.

5. Downhole inflow production restriction device according to claim 2, wherein the brine dissolvable element comprises both at least part of the valve housing and the movable part.

6. Downhole inflow production restriction device according to claim 3, wherein the movable part is at least partly arranged in the device opening.

7. Downhole inflow production restriction device according to claim 2, wherein the valve housing comprises a first housing part and a second housing part, the first housing part being fixedly arranged in the opening of the well tubular metal structure and the second housing part being part of the brine dissolvable element.

8. Downhole inflow production restriction device according to claim 1, wherein the brine dissolvable element comprises a rod part, a first projecting flange arranged at a first end of the rod part and a second projecting flange arranged at a second end of the rod part, the rod part extending through the device opening, so that the first projecting flange is arranged outside the device opening at one side of the restriction device and has an outer diameter (OD1) which is larger than an inner diameter (IDD) of the device opening, and so that the second projecting flange is arranged outside the device opening at the other side of the restriction device and has an outer diameter (OD2) which is larger than the inner diameter of the device opening.

9. Downhole inflow production restriction device according to claim 8, wherein the second projecting flange is facing the inside of the well tubular metal structure and the first projecting flange has a flange opening allowing fluid to flow from outside of the well tubular metal structure to inside of the well tubular metal structure when the valve is in the first position.

10. Downhole inflow production restriction device according to claim 1, further comprising a snap ring configured to fasten the downhole inflow production restriction device in the opening of the well tubular metal structure.

11. Downhole completion system comprising the well tubular metal structure and the downhole inflow production restriction device according to claim 1.

12. Downhole completion system according to claim 11, wherein the well tubular metal structure comprises at least one screen mounted on the outer face of the well tubular metal structure and opposite the downhole inflow production restriction device.

13. Downhole completion system according to claim 11, wherein the well tubular metal structure comprises at least one annular barrier for providing zonal isolation.

14. Downhole inflow production restriction device according to claim 1, wherein the weak point is configured to allow at least a part of the brine dissolvable element to break off due to the indentation if the brine dissolvable element is not dissolved or not dissolved to a sufficient extent for the brine dissolvable element to be released to open the opening.

15. Downhole inflow production restriction device according to claim 14, wherein the part is a flange.

16. Downhole inflow production restriction device according to claim 1, wherein the weak point is configured to break at or along the indentation in case the element is not released through dissolving alone.

17. Downhole inflow production restriction device according to claim 1, wherein the brine dissolvable element is configured to be released to open the opening by both dissolving and by breaking at or along the indentation.

18. Completion method for preparing a well for production, said completion method comprising:

running a well tubular metal structure in the borehole while circulating mud, the well tubular metal structure having an opening in which a downhole inflow production restriction device is mounted, the downhole inflow production restriction device comprising a device opening, and a brine dissolvable element configured to prevent flow from within the well tubular metal structure through the device opening to an outside of the well tubular metal structure before the brine dissolvable element is at least partly dissolved in brine, wherein the brine dissolvable element is at least partly made of a magnesium alloy and comprises an indentation forming a weak point where an increase in pressure in the well tubular metal structure is configured to cause the brine dissolvable element to break at this weak point circulating brine from inside the well tubular metal structure out through a bottom of the well tubular metal structure and up along the well tubular metal structure, decreasing the pressure in the well tubular metal structure, and initiating production of fluid flowing into the well tubular metal structure through the device opening by dissolving the brine dissolvable element in the device opening so that mud is transported with the fluid uphole.

19. Completion method according to claim 18, further comprising:

dropping a ball to be seated near the bottom of the well tubular metal structure to pressurise the well tubular metal structure from within, and expanding an expandable metal sleeve of an annular barrier by allowing fluid of the increased pressure in the well tubular metal structure to enter an annular space between the expandable metal sleeve and the well tubular metal structure through an expansion opening in the well tubular metal structure.

* * * * *